US012796828B2

(12) United States Patent
Cao

(10) Patent No.: US 12,796,828 B2
(45) Date of Patent: Nov. 17, 2026

(54) INFLATABLE COT

(71) Applicant: Ningbo Snowwolf Outdoor Products Technology Co., Ltd., Ningbo (CN)

(72) Inventor: Yun Cao, Ningbo (CN)

(73) Assignee: NINGBO SNOWWOLF OUTDOOR PRODUCTS TECHNOLOGY CO., LTD., Ningbo (CN)

( * ) Notice: Subject to any disclaimer, the term of this patent is extended or adjusted under 35 U.S.C. 154(b) by 0 days.

(21) Appl. No.: 19/015,835

(22) Filed: Jan. 10, 2025

(65) Prior Publication Data

US 2025/0228373 A1 Jul. 17, 2025

(30) Foreign Application Priority Data

Jan. 11, 2024 (CN) ..... 202410048330.1

(51) Int. Cl.

| | |
|---|---|
| ***A47C 27/08*** | (2006.01) |
| ***A47C 19/00*** | (2006.01) |
| ***A47C 19/02*** | (2006.01) |
| *A47C 17/64* | (2006.01) |

(52) U.S. Cl.

CPC ..... *A47C 27/081* (2013.01); *A47C 19/005* (2013.01); *A47C 19/024* (2013.01); *A47C 27/087* (2013.01); *A47C 17/645* (2013.01)

(58) Field of Classification Search

CPC ... A47C 27/081; A47C 19/024; A47C 19/005; A47C 31/023; A47C 17/645

USPC ..... 5/706

See application file for complete search history.

(56) References Cited

U.S. PATENT DOCUMENTS

| | | | | |
|---|---|---|---|---|
| 3,045,257 | A * | 7/1962 | Knapp | A47C 27/081 5/112 |
| 2006/0000020 | A1* | 1/2006 | Matheus | A47C 27/081 5/706 |
| 2022/0248869 | A1* | 8/2022 | Zhu | A47C 17/64 |
| 2023/0218090 | A1* | 7/2023 | Lin | A47C 27/087 156/87 |

FOREIGN PATENT DOCUMENTS

| | | |
|---|---|---|
| CN | 212139988 U | 12/2020 |
| CN | 217885522 U | 11/2022 |

* cited by examiner

*Primary Examiner* — David R Hare
*Assistant Examiner* — Joseane E. Tejada
(74) *Attorney, Agent, or Firm* — Bayramoglu Law Offices LLC

(57) ABSTRACT

An inflatable cot includes: a main body, where the top of the main body is provided with a cot surface, the main body is internally provided with an inflation cavity, the inflation cavity is internally provided with several fabric strands, two ends of each of the fabric strands are respectively connected to the top and the bottom of the inflation cavity, and the bottom of the main body is provided with connection portions; and a support frame, where the support frame includes connection rods and support legs, the connection rods are detachably inserted into the connection portions, and the support legs are detachably connected to the connection rods. In the inflatable cot, support performance of the cot can be improved, thereby improving comfortableness.

10 Claims, 2 Drawing Sheets

INFLATABLE COT

CROSS REFERENCE TO THE RELATED APPLICATIONS

This application is based upon and claims priority to Chinese Patent Application No. 202410048330.1, filed on Jan. 11, 2024, the entire contents of which are incorporated herein by reference.

TECHNICAL FIELD

The present invention relates to the field of cot technologies, and in particular, to an inflatable cot.

BACKGROUND

Cots are foldable beds used by military units mostly on the march or in the wild, and are made of wooden frames or metal frames bound with canvas. Cots folded and bagged are small in volume and are characterized by their portability. In the conventional technologies, a cot includes a cot frame and a cot fabric. A user unfolds the cot frame and binds the cot fabric to the cot frame for use, so that the user can lie on the cot fabric. Cots are usually poor in support performance due to cot fabric material issues. Consequently, users cannot get enough support when lying on the cots, and may feel less comfortable. In addition, cots on the market are usually 60 cm to 75 cm wide, and there is no sufficient rest space for users to lie on the cots, affecting user experience. Therefore, a more comfortable inflatable cot is needed.

SUMMARY

The present invention provides an inflatable cot, which can improve support performance of the cot, thereby improving comfortableness.

To solve the foregoing technical problem, the present invention provides an inflatable cot, including:

a main body, where the top of the main body is provided with a cot surface, the main body is internally provided with an inflation cavity, the inflation cavity is internally provided with several fabric strands, two ends of each of the fabric strands are respectively connected to the top and the bottom of the inflation cavity, and the bottom of the main body is provided with connection portions; and a support frame, where the support frame includes connection rods and support legs, the connection rods are detachably inserted into the connection portions, and the support legs are detachably connected to the connection rods.

As a preferred design of the foregoing technical solution, the main body includes an upper film layer, an upper base fabric, a lower film layer, and a lower base fabric, the upper film layer is connected to the upper base fabric in an adhesive manner, the lower film layer is connected to the lower base fabric in an adhesive manner, and the two ends of each of the fabric strands are respectively connected to the upper base fabric and the lower base fabric.

As a preferred design of the foregoing technical solution, the main body further includes a side wall, an upper edge of the side wall is connected to the upper film layer in a hot melting or adhesive manner, a lower edge of the side wall is fixedly connected to the lower film layer in a hot melting or adhesive manner, and the upper film layer, the side wall, and the lower film layer are mated to form the inflation cavity.

As a preferred design of the foregoing technical solution, the inflatable mattress further includes an inflation/deflation valve, the inflation/deflation valve is disposed on the main body, and the inflation/deflation valve is in communication with the inflation cavity.

As a preferred design of the foregoing technical solution, the connection portions are flexible connection sleeves, and the connection rods are inserted into the flexible connection sleeves.

As a preferred design of the foregoing technical solution, there are a plurality of flexible connection sleeves, and the plurality of flexible connection sleeves are evenly distributed on both sides of the bottom of the main body.

As a preferred design of the foregoing technical solution, there are two connection rods and three support legs, and the same one of the support legs is detachably connected to the both of the connection rods.

As a preferred design of the foregoing technical solution, the three support legs are evenly distributed on the connection rods.

As a preferred design of the foregoing technical solution, each of the support legs is provided with two snap-fit portions, and both of the connection rods are respectively detachably snapped into the snap-fit portions.

As a preferred design of the foregoing technical solution, the bottom of the main body is provided with a storage bag.

The present invention provides the inflatable cot, including the main body and the support frame. The main body is internally provided with the inflation cavity. The inflation cavity is internally provided with the several fabric strands. The two ends of each of the fabric strands are respectively connected to the top and the bottom of the inflation cavity. The fabric strands play a role of limiting the shape of the inflation cavity after the inflation cavity is fully inflated. Sufficient fabric strands can enable the inflatable mattress to withstand greater air pressure, so that the main body has a better support effect, and a user can lie on the cot surface more comfortably, thereby improving user experience. The support frame is disposed to support the main body off the ground, so that the user can be protected from impact of an uneven ground when the inflatable cot is used on the uneven ground, thereby improving comfortableness. In addition, the main body is 90 cm to 100 cm wide, which enables the user to have enough rest space, turn over, and the like when lying thereon, thereby further improving comfortableness. To use the inflatable cot, the main body is fully inflated, the connection rods are inserted into the connection portions, and then the support legs are mounted onto the connection rods, to complete assembly of the inflatable cot. The mounting process is simple and convenient, with improved ease of use.

The foregoing descriptions are merely an overview of the technical solutions of the present invention. To understand the technical means of the present invention more clearly, the technical means may be implemented according to the content of this specification. In addition, to make the foregoing and other objectives, features, and advantages of the present invention clearer and easier to understand, the following describes specific implementations of the present invention.

In the figures: 1. main body; 2. support frame; 3. inflation/deflation valve; 101. cot surface; 102. inflation cavity; 103. fabric strand; 104. connection portion; 105. upper film layer; 106. upper base fabric; 107. lower film layer; 108. lower base fabric; 109. side wall; 110. storage bag; 201. connection rod; 202. support leg; and 203. snap-fit portion.

DETAILED DESCRIPTION OF THE EMBODIMENTS

To make the objectives, features, and advantages of the present invention clearer and easier to understand, the following clearly and completely describes the technical solutions in the embodiments of the present invention with reference to the accompanying drawings in the embodiments of the present invention. Clearly, the described embodiments are merely some rather than all of the embodiments of the present invention. Based on the embodiments in the present invention, all other embodiments obtained by a person skilled in the art without creative efforts shall fall within the protection scope of the present invention.

Figure 1:
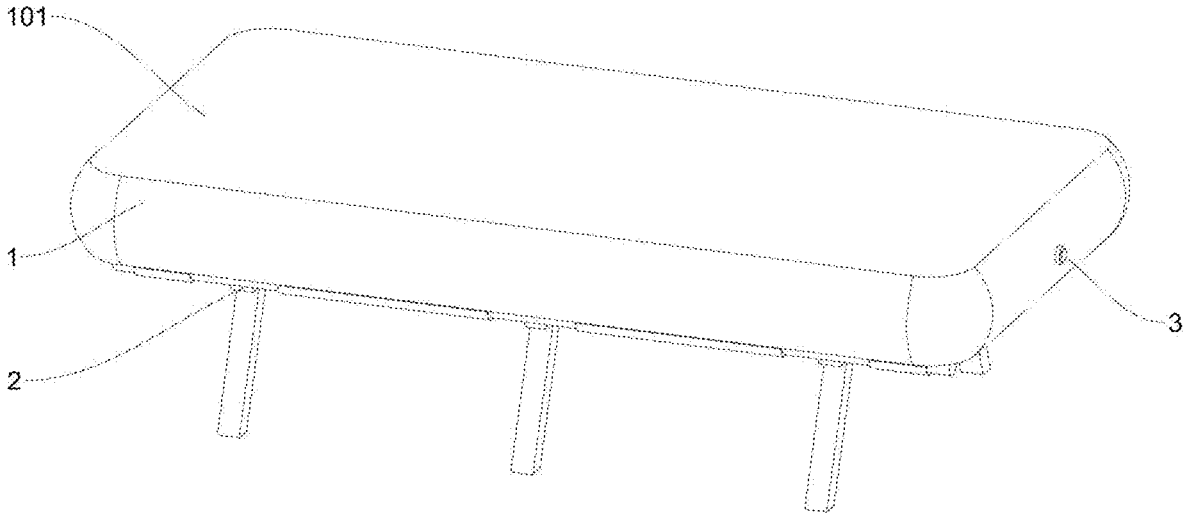
FIG. 1 is a schematic diagram of a three-dimensional structure of an inflatable cot according to an embodiment of the present invention.
Figure 2:
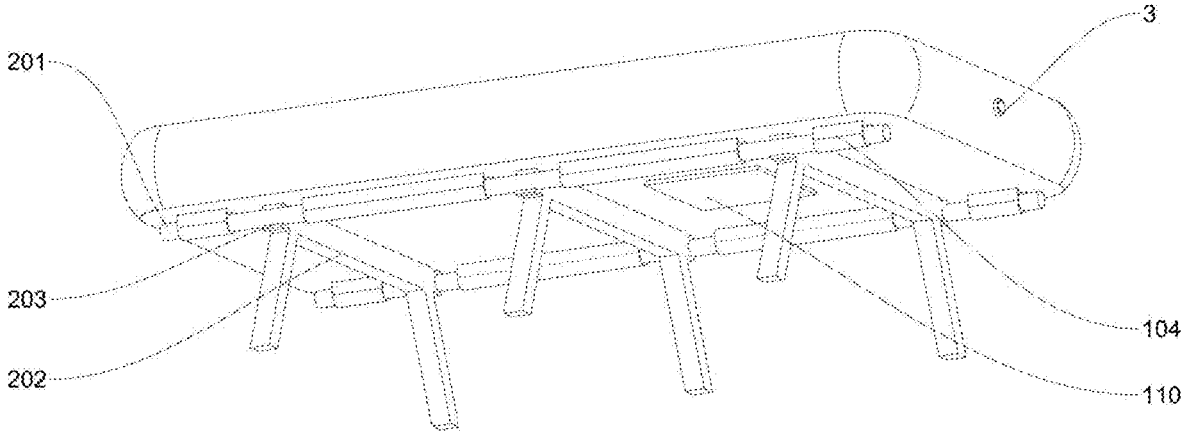
FIG. 2 is a schematic diagram of a three-dimensional structure of an inflatable cot according to an embodiment of the present invention.
Figure 3:
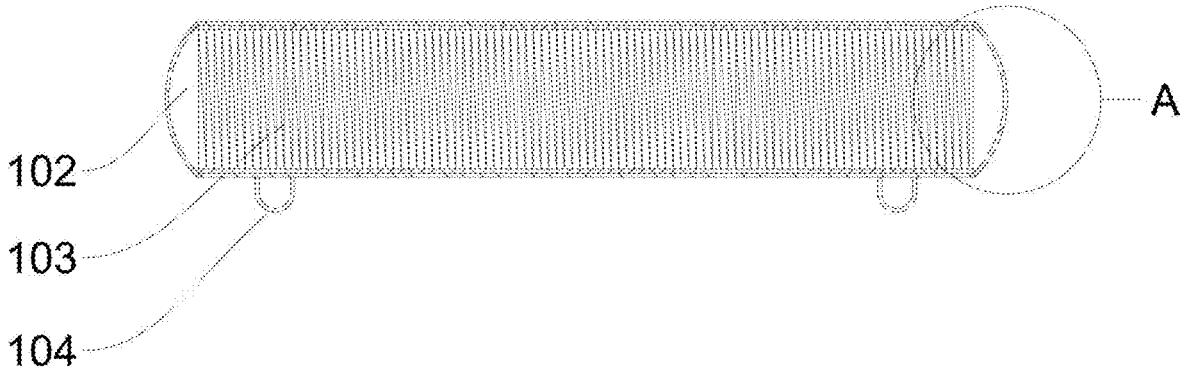
FIG. 3 is a schematic diagram of a structure of an inflatable cot according to an embodiment of the present invention.
Figure 4:
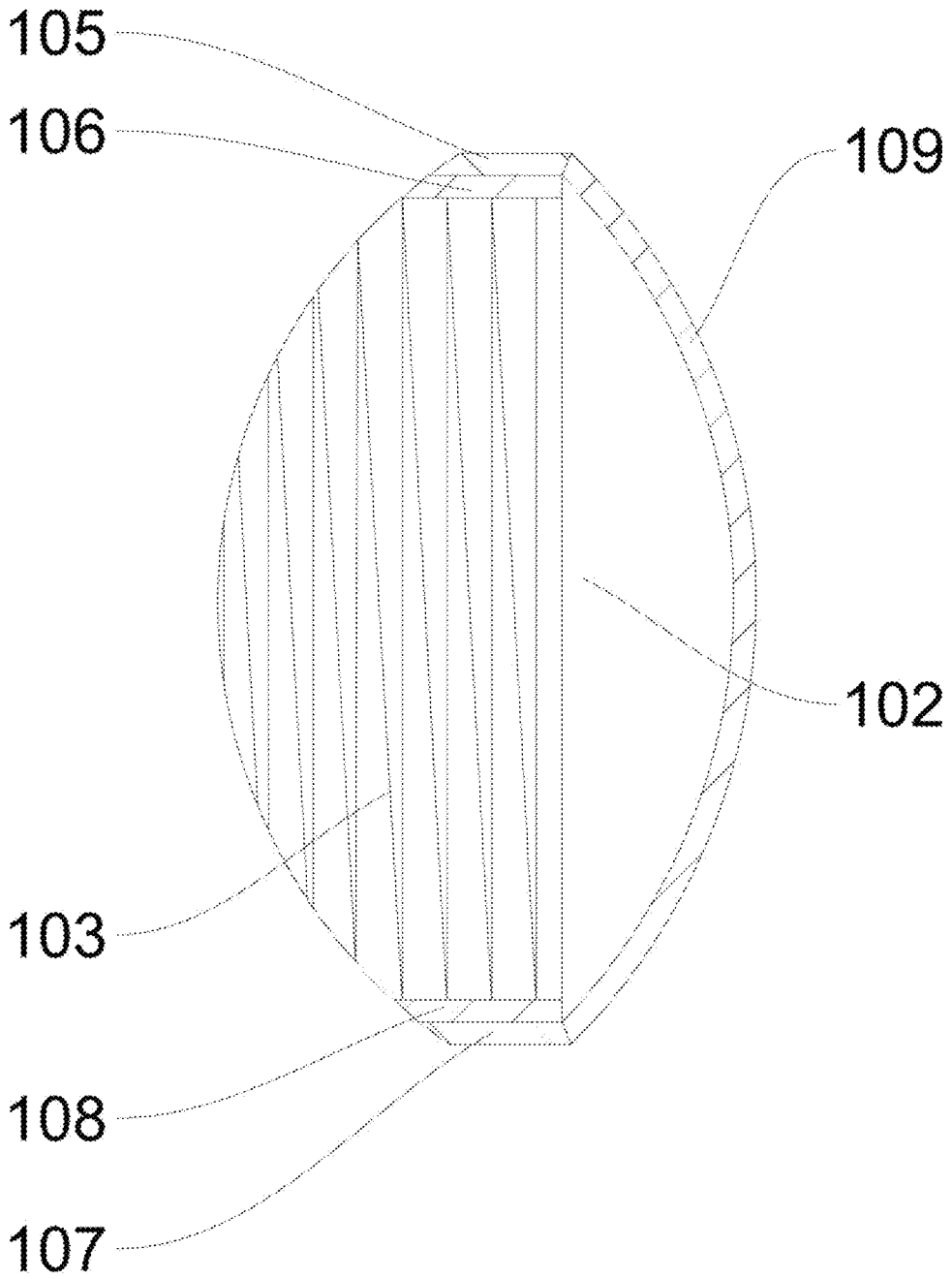
FIG. 4 is a partially enlarged view of A in FIG. 3.

Referring to FIG. 1 to FIG. 4, an embodiment of the present invention provides an inflatable cot, including:

- a main body 1, where the top of the main body 1 is provided with a cot surface 101, the main body 1 is internally provided with an inflation cavity 102, the inflation cavity 102 is internally provided with several fabric strands 103, two ends of each of the fabric strands 103 are respectively connected to the top and the bottom of the inflation cavity 102, and the bottom of the main body 1 is provided with connection portions 104; and
- a support frame 2, where the support frame 2 includes connection rods 201 and support legs 202, the connection rods 201 are detachably inserted into the connection portions 104, and the support legs 202 are detachably connected to the connection rods 201.

The present invention provides the inflatable cot, including the main body 1 and the support frame 2. The main body 1 is internally provided with the inflation cavity 102. The inflation cavity 102 is internally provided with the several fabric strands 103. The two ends of each of the fabric strands 103 are respectively connected to the top and the bottom of the inflation cavity 102. The fabric strands 103 play a role of limiting the shape of the inflation cavity 102 after the inflation cavity 102 is fully inflated. Sufficient fabric strands 103 can enable the inflatable mattress to withstand greater air pressure, so that the main body 1 has a better support effect, and a user can lie on the cot surface 101 more comfortably, thereby improving user experience. The support frame 2 is disposed to support the main body 1 off the ground, so that the user can be protected from impact of an uneven ground when the inflatable cot is used on the uneven ground, thereby improving comfortableness. In addition, the main body 1 is 90 cm to 100 cm wide, which enables the user to have enough rest space, turn over, and the like when lying thereon, thereby further improving comfortableness. To use the inflatable cot, the main body 1 is fully inflated, the connection rods 201 are inserted into the connection portions 104, and then the support legs 202 are mounted onto the connection rods 201, to complete assembly of the inflatable cot. The mounting process is simple and convenient, with improved ease of use.

In a further feasible implementation of this embodiment, the main body 1 includes an upper film layer 105, an upper base fabric 106, a lower film layer 107, and a lower base fabric 108. The upper film layer 105 is connected to the upper base fabric 106 in an adhesive manner, the lower film layer 107 is connected to the lower base fabric 108 in an adhesive manner, and the two ends of each of the fabric strands 103 are respectively connected to the upper base fabric 106 and the lower base fabric 108.

In this embodiment, the upper film layer 105 and the upper base fabric 106 form an upper portion of the inflation cavity 102, and the lower film layer 107 and the lower base fabric 108 form a lower portion of the inflation cavity 102. During production and processing, the upper base fabric 106 and the lower base fabric 108 are first connected together by using the fabric strands 103, and the upper film layer 105 and the lower film layer 107 are respectively adhered to the upper base fabric 106 and the lower base fabric 108, to facilitate production and manufacturing.

In a further feasible implementation of this embodiment, the main body 1 further includes a side wall 109. An upper edge of the side wall 109 is connected to the upper film layer 105 in a hot melting or adhesive manner, a lower edge of the side wall 109 is fixedly connected to the lower film layer 107 in a hot melting or adhesive manner, and the upper film layer 105, the side wall 109, and the lower film layer 107 are mated to form the inflation cavity 102.

In this embodiment, the main body 1 further includes the side wall 109. The upper film layer 105 and the lower film layer 107 are connected by using the side wall 109. The upper film layer 105, the lower film layer 107, and the side wall 109 are mated to form the inflation cavity 102. The width of the side wall 109 corresponds to the length of the fabric strands 103. If the upper film layer 105 and the lower film layer 107 are directly connected, the upper film layer 105 and the lower film layer 107 are subject to a large tension force at the connection portions 104, and are prone to damage. However, the overall thickness of the inflatable mattress after full inflation is limited when the side wall 109 and the fabric strands 103 are mated. In this way, the inflatable mattress can withstand greater air pressure, and the inflatable mattress has a better support effect and is more comfortable. All of the upper film layer 105, the side wall 109, and the lower film layer 107 employ a TPU material or a PVC material. The TPU material is characterized by excellent wear resistance, which can enable the inflatable mattress to be more durable and more suitable for use in complex environments such as outdoors. The TPU material is further characterized by aging resistance and resistance to brittle at low temperatures. Therefore, a service life of the inflatable mattress can be effectively prolonged. The TPU material further exhibits characteristics such as softness, high strength, and good elasticity. These characteristics allow the inflation cavity 102 to withstand greater air pressure, so that the inflatable mattress has a better support effect and is more comfortable. In addition, the TPU material is further characterized by being free from extraneous odor, which can further improve comfortableness of the user during use. The PVC material is characterized by being water-proof and wear-resistant. Therefore, the PVC material is suitable for use in complex environments such as outdoors, and is low in prices and can effectively reduce production costs.

In a further feasible implementation of this embodiment, the inflatable mattress further includes an inflation/deflation valve 3. The inflation/deflation valve 3 is disposed on the main body 1, and the inflation/deflation valve 3 is in communication with the inflation cavity 102.

In this embodiment, the inflatable mattress further includes the inflation/deflation valve 3. The inflation/deflation valve 3 is disposed on the main body 1. The inflation/deflation valve 3 is in communication with the inflation cavity 102. The user may inflate/deflate the inflation cavity 102 through the inflation/deflation valve 3, thereby improving ease of use. In addition, air pressure of a gas inside the inflation cavity 102 may be adjusted through the inflation/deflation valve 3. In this way, a degree of softness/hardness of the inflatable mattress can be adjusted, thereby solving a problem that softness/hardness of a conventional mattress cannot be adjusted.

In a further feasible implementation of this embodiment, the connection portions 104 are flexible connection sleeves, and the connection rods 201 are inserted into the flexible connection sleeves.

In this embodiment, the connection portions 104 are flexible connection sleeves, which are convenient for folding and storing the main body 1 after deflation. In addition, the flexible connection sleeves do not abrade the lower film layer 107 during use and during folding and storage, thereby avoiding air leakage and prolonging a service life of the main body 1.

In a further feasible implementation of this embodiment, there are a plurality of flexible connection sleeves, and the plurality of flexible connection sleeves are evenly distributed on both sides of the bottom of the main body 1.

In this embodiment, during use, the connection rods 201 are inserted into the flexible connection sleeves, and the support legs 202 are mounted onto the connection rods 201. The support legs 202 play a role of supporting the main body 1. The plurality of flexible connection sleeves are evenly distributed on both sides of the bottom of the main body 1, so that the main body 1 is subject to a more uniform support force, and the main body 1 is prevented from being rolled over in use, thereby improving comfortableness of the user during use.

In a further feasible implementation of this embodiment, there are two connection rods 201 and three support legs. The same one of the support legs is detachably connected to both of the connection rods 201.

In this embodiment, there are two connection rods 201 and three support legs. Both sides of each of the support legs are respectively detachably connected to both of the connection rods 201, and the two connection rods 201 are respectively inserted into the flexible connection sleeves on both sides of the bottom of the main body 1. In this way, the support legs can better support the main body 1, and the main body 1 is prevented from being rolled over in use, thereby improving comfortableness of the user during use.

In a further feasible implementation of this embodiment, the three support legs are evenly distributed on the connection rods 201.

In this embodiment, the three support legs are respectively mounted at positions corresponding to a head portion, a middle portion, and a tail portion of the main body 1, to better support the main body 1, and prevent the main body 1 from being rolled over in use, thereby improving comfortableness of the user during use.

In a further feasible implementation of this embodiment, each of the support legs is provided with two snap-fit portions 203, and both of the connection rods 201 are respectively detachably snapped into the snap-fit portions 203.

In this embodiment, each of the support legs is provided with two snap-fit portions 203. The two snap-fit portions 203 are respectively disposed on both sides of the support leg. To use the inflatable cot, the user only needs to respectively snap the two connection rods 201 into the two snap-fit portions 203 to complete connection between the support legs and the connection rods 201. A structure is simple, an operation is convenient, and ease of use is improved.

In a further feasible implementation of this embodiment, the bottom of the main body 1 is provided with a storage bag 110.

In this embodiment, the bottom of the main body 1 is provided with the storage bag 110. The storage bag 110 may be configured to store accessories such as a dust cover, and is convenient for use by the user during storage. During use after inflation, the user may also use the storage bag 110 to place personal items to avoid loss.

In the descriptions of this specification, descriptions provided with reference to terms such as "an embodiment", "some embodiments", "an example", "a specific example", or "some examples" intend to mean that a specific feature, structure, material, or characteristic described with reference to the embodiment or example is included in at least one embodiment or example of the present invention. In addition, the described specific feature, structure, material, or characteristic can be combined in a proper manner in any one or more of the embodiments or examples. In addition, a person skilled in the art can integrate and combine different embodiments or examples and features in different embodiments or examples described in this specification, provided that they do not conflict with each other.

In addition, the terms "first" and "second" are used merely for description purposes, and cannot be understood as indicating or implying relative importance or implicitly indicating the quantity of indicated technical features. Therefore, a feature defined with "first" or "second" may explicitly or implicitly include at least one feature. In the descriptions of the present invention, "a plurality of" means two or more, unless otherwise specifically limited.

The foregoing descriptions are merely specific implementations of the present invention, but are not intended to limit the protection scope of the present invention. Any variation or replacement readily figured out by a person skilled in the art within the technical scope disclosed in the present invention shall fall within the protection scope of the present invention. Therefore, the protection scope of the present invention shall be subject to the protection scope of the claims.

What is claimed is:

1. An inflatable cot, comprising:

a main body, wherein a top of the main body is provided with a cot surface, the main body is internally provided with an inflation cavity, the inflation cavity is internally provided with a plurality of fabric strands, two ends of each of the plurality of fabric strands are respectively connected to a top and a bottom of the inflation cavity, and a bottom of the main body is provided with connection portions, wherein the connection portions are flexible connection sleeves, there are a plurality of flexible connection sleeves, and the plurality of flexible connection sleeves are evenly distributed on both sides of the bottom of the main body; and a support frame, wherein the support frame comprises two connection rods and a plurality of support legs, the connection rods are detachably inserted into the flexible connection sleeves, each of the plurality of support legs is detachably connected to both of the two connection rods, the plurality of support legs are mounted at positions corresponding to a head portion, a middle portion, and a tail portion of the main body, each of the plurality of support legs is provided with two snap-fit portions respectively disposed on both sides of the plurality of support legs, and the two connection rods are respectively detachably snapped into the two snap-fit portions.

2. The inflatable cot according to claim 1, wherein the main body comprises an upper film layer, an upper base fabric, a lower film layer, and a lower base fabric, wherein the upper film layer is connected to the upper base fabric in a first adhesive manner, the lower film layer is connected to the lower base fabric in a second adhesive manner, and the two ends of each of the plurality of fabric strands are respectively connected to the upper base fabric and the lower base fabric.

3. The inflatable cot according to claim 2, wherein the main body further comprises a side wall, wherein an upper edge of the side wall is connected to the upper film layer in a first hot melting or adhesive manner, a lower edge of the side wall is fixedly connected to the lower film layer in a second hot melting or adhesive manner, and the upper film layer, the side wall, and the lower film layer are mated to form the inflation cavity.

4. The inflatable cot according to claim 1, further comprising an inflatable mattress, wherein the inflatable mattress comprises an inflation/deflation valve, the inflation/deflation valve is disposed on the main body, and the inflation/deflation valve is in communication with the inflation cavity.

5. The inflatable cot according to claim 1, wherein the main body comprises a lower film layer, and the flexible connection sleeves do not abrade the lower film layer during use and during folding and storage, thereby avoiding air leakage.

6. The inflatable cot according to claim 5, wherein the flexible connection sleeves are evenly distributed on both sides of the bottom of the main body.

7. The inflatable cot according to claim 6, wherein the connection rods comprise two connection rods, and the plurality of support legs comprises three support legs, wherein each of the plurality of support legs is detachably connected to the two connection rods.

8. The inflatable cot according to claim 7, wherein the plurality of support legs are evenly distributed on the two connection rods.

9. The inflatable cot according to claim 8, wherein all of the upper film layer, the side wall, and the lower film layer employ a TPU material or a PVC material.

10. The inflatable cot according to claim 1, wherein the bottom of the main body is provided with a storage bag, wherein the storage bag is configured to store a dust cover and the storage bag is configured to hold personal items.

* * * * *